US009192252B2

(12) United States Patent
Lindblom et al.

(10) Patent No.: US 9,192,252 B2
(45) Date of Patent: Nov. 24, 2015

(54) CART FOR TRANSPORTING SHELVING

(71) Applicant: Streater LLC, Albert Lea, MN (US)

(72) Inventors: Thomas G. Lindblom, Claremont, MN (US); Lance Engebretson, Albert Lea, MN (US); Nicholas D. Olson, Thompson, IA (US); Randy R. Guthrie, Paragould, AR (US)

(73) Assignee: STREATER LLC, Albert Lea, MN (US)

( * ) Notice: Subject to any disclaimer, the term of this patent is extended or adjusted under 35 U.S.C. 154(b) by 172 days.

(21) Appl. No.: 14/027,851

(22) Filed: Sep. 16, 2013

(65) Prior Publication Data

US 2015/0076779 A1 Mar. 19, 2015

(51) Int. Cl.
*B62B 3/00* (2006.01)
*A47F 5/13* (2006.01)

(52) U.S. Cl.
CPC ..... *A47F 5/137* (2013.01)

(58) Field of Classification Search
USPC ..... 280/79.3, 47.35, 79.11, 47.34
See application file for complete search history.

(56) References Cited

U.S. PATENT DOCUMENTS

| | | | | |
|---|---|---|---|---|
| 3,007,708 | A | 11/1961 | Ochs | |
| 3,908,562 | A | 9/1975 | Wittschen | |
| 3,953,044 | A | 4/1976 | Wilson | |
| 3,977,689 | A | 8/1976 | Rosa | |
| 4,045,043 | A | 8/1977 | Fourrey | |
| 4,350,357 | A * | 9/1982 | Zenner et al. | 280/79.3 |
| 4,416,463 | A | 11/1983 | Marsh, Jr. | |
| 5,040,690 | A | 8/1991 | van der Schoot | |
| 5,782,600 | A | 7/1998 | Walsh | |
| 5,875,904 | A | 3/1999 | Vorstenbosch | |
| 6,402,167 | B1 * | 6/2002 | Calleja | 280/79.3 |
| 7,104,555 | B1 | 9/2006 | Davis | |
| 7,549,654 | B2 | 6/2009 | Anderson et al. | |
| 2008/0251483 | A1 * | 10/2008 | Davis et al. | 211/187 |

OTHER PUBLICATIONS

Herbertwilliams—Oct. 11, 2012—3 Sided Slat Trucks (4 shelves).

* cited by examiner

*Primary Examiner* — Jeffrey J Restifo
*Assistant Examiner* — Erez Gurari
(74) *Attorney, Agent, or Firm* — Nikolai & Mersereau, P.A.; Thomas J. Nikolai

(57) ABSTRACT

Storage and transport of a gondola-type shelving with safety achieved by providing a wheeled cart system having shelves limiting the height of any stack of the gondola-type shelves and both vertical and horizontal guard rails which may be readily affixed or removed from the cart as necessary to enable loading and unloading of the cart and safe storage and transport of items in the cart.

15 Claims, 6 Drawing Sheets

30
46
44
42
42
64
61
-88-
46
32
94
68
44
40
34
-88-
60
59
44
46
48
70
52
58
57
50
50
38
46
56
-88-
86
52
48
50
72
48
55
48
62
92
-88-
83
36
84
80
84
92
90
66
82
54
81

CART FOR TRANSPORTING SHELVING

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

The present invention relates to devices for storing and transporting shelving. More specifically, the invention relates to a wheeled cart upon which a large number of shelves may be stacked at a first location, safely transported to a second location, and safely unstacked at the second location.

II. Related Art

Gondola-type shelving is used in retail stores throughout the world. A significant advantage of gondola-type shelving is that the shelving is modular in design allowing the shelving to be assembled in units ranging in width from as short as two to three feet to as long as a hundred feet or more. Another significant advantage is that the number of shelves in a particular section of the unit may be altered and the spacing between the shelves in a particular section of the unit may also be altered.

Still another advantage of gondola-type shelving is that a shelving unit and sections of the shelving unit may be quickly assembled and disassembled. This is important because time is of the essence when rearranging the shelves of a retail store. This work must typically be accomplished between the time a store closes in the evening and the time the store opens in the morning. When a store is open 24 hours per day, like many big box retail department stores such as those operated by Walmart or drug stores such as those operated by Walgreens, the task of disassembling, moving and reassembling shelving units must be accomplished when customers are in the store. Whether the shelving units are moved or reconfigured when customers are present or not, safety is an issue.

Significant safety concerns arise when the shelves of a gondola-type shelving unit are stacked and transported. Gondola-type shelves are not perfectly flat and when stacked they tend to be relatively unstable. The degree of instability increases with each shelf added to the stack. Stacks have been known to collapse, causing damage to the shelves and even bodily injury to workers or others adjacent the stack. This problem is particularly acute when the stack rests on a flat bed cart used to transport the stack of shelves. This problem is exacerbated by laborers trying to speed the process by stacking a larger number of shelves than they should or being careless when adding or removing shelves from a stack.

SUMMARY OF THE INVENTION

The present invention addresses these important safety concerns by providing a cart specifically designed to transport a plurality of gondola-type shelves. The cart provides lateral support along each of the four sides of a stack preventing the stack from collapsing during transport. Likewise, because the cart divides the stack into separately supported increments, all portions of the composite stack are generally stable even in the absence of such lateral support.

More specifically, the present invention comprises a cart including a frame, a plurality of dividing shelves on which the gondola shelves are to be loaded, and four wheel assemblies, at least two of which are typically castered. The frame has a front pair of pillars consisting of vertical right front and vertical left front pillars. These pillars are joined together by a plurality of vertically spaced horizontal supports. The frame also has a back pair of pillars consisting of vertical right rear and vertical left rear pillars joined together by a plurality of vertically spaced horizontal supports. The distance between the two pillars of each pair is preferable slightly longer than the length of the shelves to be supported by the cart. The frame also includes a pair of horizontal side supports joining the vertical right front and rear pillars and a pair of horizontal side supports joining the vertical left front and rear pillars. The frame further includes a first oblique support extending between one of the left vertical pillars near the top and the other of the left vertical pillars near the bottom. Likewise, a second oblique support extends between one of the right vertical pillars near the top and the other of the right vertical pillars near the bottom. The lengths of the horizontal side supports are slightly longer than the depth of the gondola shelves to be stacked. The frame supports a plurality of fixed shelves. More specifically, the shelves may be supported by the vertically spaced horizontal supports extending between the front and the back pairs of pillars. The wheels of the wheel assemblies support the frame.

The shelves provide a significant safety feature because they prevent too many gondola shelves from being stacked directly on top of each other. To provide additional safety, vertical guard rails and horizontal guard rails are provided and may be employed.

A first vertical guard rail is provided between the bottom and top horizontal supports that extend between the front pair of pillars. A second vertical guard rail extends between the bottom and top horizontal supports extending between the back pair of pillars. More specifically, these bottom horizontal supports have a cup attached to the outer face which is open to the top and receives and supports the bottom of a vertical guard rail. The top horizontal supports have a U-shaped bracket attached to the outer face which is open to both the top and bottom and receives and supports the top of the vertical guard rail.

The horizontal guard rails each comprise a flat plate having knobs extending perpendicularly in a first direction from an inside surface of the plate adjacent the opposite ends of the plate. The knobs may be hook-shaped or terminate in a flange. The pillars each have a plurality of holes positioned along the length of the pillars. The holes are sized and shaped to receive the knobs and cooperate with the knobs to temporarily, yet securely, fasten the horizontal guard rails to the frame of the cart. The horizontal guard rails can be attached to the frame as the gondola shelves are added such that the stack receives lateral support from the guard rails, but the guard rails do not interfere with stacking of shelves on the cart. Likewise, the horizontal guard rails may be removed from the frame as the gondola shelves are removed to provide adequate lateral support at all times to prevent the stack of gondola shelves from tipping and yet permit the shelves to be unstacked from the cart without undue interference from the horizontal guard rails.

BRIEF DESCRIPTION OF THE DRAWINGS

The foregoing features, objects and advantages will become apparent to those skilled in the art from the following detailed description and with reference to the following drawings in which like numerals in the several views refer to corresponding parts.

DETAILED DESCRIPTION

Figure 1:
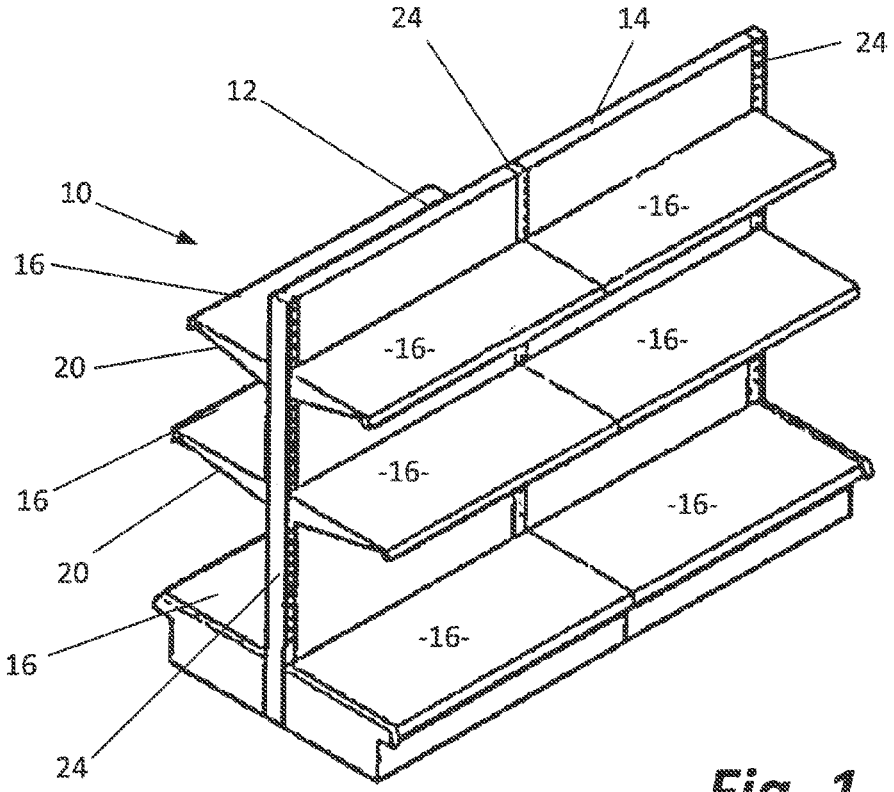
FIG. 1 is a perspective view of a pair of gondola-style shelving units.

This description of the preferred embodiment is intended to be read in conjunction with the accompanying drawings, which are to be considered part of the entire written description. In the description, relative terms such as lower, upper, horizontal, vertical, above, below, up, down, top, bottom, front and back as well as derivatives thereof (e.g., horizontally, downwardly, upwardly, etc.) should be construed to refer to the orientation as then described or shown in the drawings under discussion. These relative terms are employed for convenience of description and do not require that the apparatus be constructed or operated in a particular orientation. Terms such as connected, connecting, attached, attaching, joined and joining are used interchangeably and refer to one structure or surface being secured directly or indirectly to another structure or surface or integrally fabricated in one piece, unless expressly described otherwise.

FIG. 1 shows a gondola-type shelving unit 10 having two sections 12 and 14. Each section has a plurality of vertically spaced adjustable shelves 16 extending from the front and back. The shelves 16 are coupled to supports 24. The position of the shelves 16 relative to the supports 24 is adjustable by virtue of the vertically spaced openings on the supports into which the shelf brackets 22 are adapted to fit.

Figure 2:
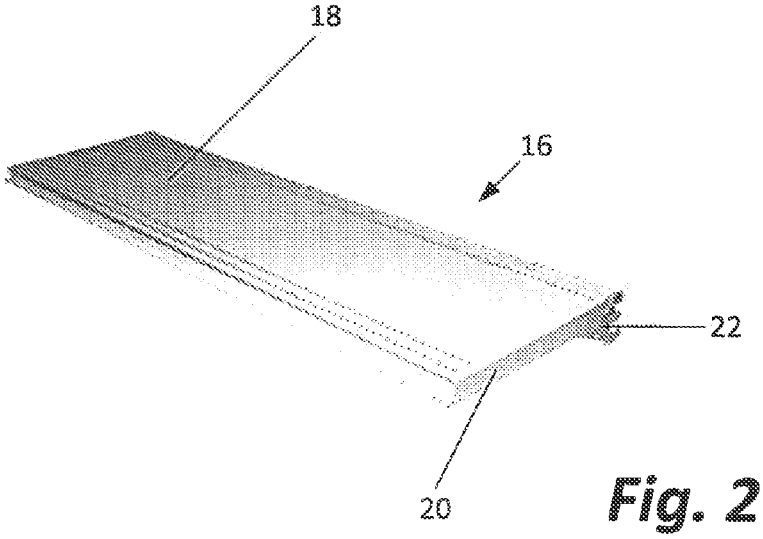
FIG. 2 is a perspective view of a shelf used as part of gondola-style shelving units shown in FIG. 1.

FIG. 2 is a perspective view of a shelf 16. FIG. 2 shows the shelves 16 having a generally flat top 18. However, the sides 20 and bottom are not flat and the brackets 22 used to attach a shelf 16 to the supports 24 of the shelving units 12 and 14 further prevent shelves 16 from sitting flat on a horizontal surface. These features of the shelf 16 make free-standing stacks of such shelves generally unstable.

FIGS. 3-11 illustrate the features of a cart 30 specifically designed to hold a stack of shelves such as those like shelf 16. The cart 30 may be used to store the stack of shelves and also may be used to transport a stack of shelves.

Figure 9:
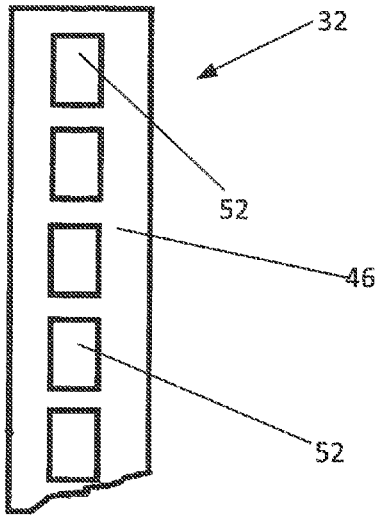
FIG. 9 is a partial front plan view of a vertical pillar including holes size and shaped to receive the knob shown in FIG. 8.
Figure 11:
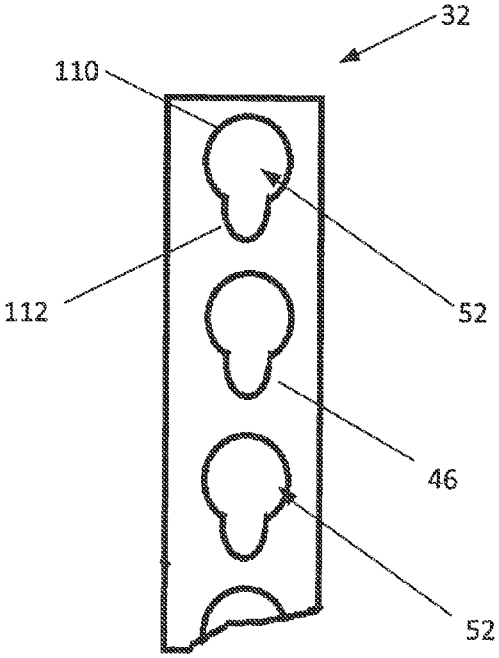
FIG. 11 is a partial front plan view of a vertical pillar including holes sized and shaped to receive the knob shown in FIG. 10.

Cart 30 comprises a frame 32. Frame 32 has a front pair of pillars consisting of a left front vertical pillar 34 and a right front vertical pillar 36. Frame 32 also has a back pair of pillars consisting of a left back vertical pillar 38 and a right back vertical pillar 40. Each of pillars 34, 36, 38 and 40 is in the form of an elongate U-shaped channel having first and second legs 42 and 44 joined by a cross member 46. The first and second legs 42 and 44 have a plurality aligned bolt holes 48 which permit the shaft of a bolt or screw 50 to pass through the first and second legs 42 and 44. Each cross member 46 also has a series of spaced holes 52 passing through the cross member 46. These holes 52 may be rectangularly shaped as illustrated in FIG. 9. Alternatively, the holes 52 may have a keyed shape with a larger diameter top portion 110 and a smaller diameter bottom portion 112 as illustrated in FIG. 11.

The frame 32 of cart 30 also includes a plurality of vertically space apart horizontal supports. These include front horizontal supports 54, 56, 58 and 60 which have opposing ends joined to pillars 34 and 36 of the front pair of pillars and back horizontal supports 55, 57, 59 and 61 which have opposing ends joined to pillars 38 and 40 of the back pair of pillars. The shaft of a bolt or screw 50 is passed through holes 48 in a pillar 34, 36, 38 or 40 to couple the end of a horizontal supports 54-61 to the pillar. The horizontal supports 54-61 each comprise an extruded metal bar having a longitudinally extending groove into which a shelf edge is fitted.

The frame also includes a plurality of left and right horizontal side supports. Horizontal side supports 62 and 64 are used to join pillars 34 and 38 and horizontal side supports 66 and 68 are used to join pillars 36 and 40. Two oblique supports 70 and 72 are also provided. As shown in the drawings, oblique support 70 extends between and is attached to a top section of pillar 38 and a bottom section of pillar 34. Oblique support 72 extends between and is attached to a top section of pillar 36 and a bottom section of pillar 40. The oblique supports 70 and 72 are also U-shaped channels and the opposed ends of the oblique supports 70 and 72 are received within the U-shaped channel of the respective pillar. Once so positioned, bolts can be passed through aligned holes in the oblique supports 70 and 72 and pillars 34, 36, 38 and 40 to complete the frame 32. The bolts are held in place in a typical fashion using nuts, washers or lock washers (not shown) as needed.

As illustrated, the frame 32 is supported by four wheel assemblies 80-83. Wheel assemblies 81 and 82 are castered to make it easy to turn the cart around corners. Wheel assemblies 81 and 82 each also include a lock 84. A handle 86 is joined to pillars 36 and 40 at a convenient height above wheels 81 and 82 to aid in moving and steering the cart.

The cart 30 includes a plurality of horizontal shelves 88. The shelves 88 are vertically spaced and are supported by the frame 32 and more specifically by the horizontal supports 54-61. The shelves 88 are a significant safety feature of the cart 30. Shelves 88 support a stack of gondola shelves 16 loaded on the cart 30 and prevent any stack of shelves from becoming dangerously high. The height of the stacks is regulated by the distance between the shelves 88. For safety reasons, shelves 16 should not be loaded on the top shelf 88 even though this shelf does provide a stable platform for tools, hardware or other items with a flat bottom surface.

Figure 3:
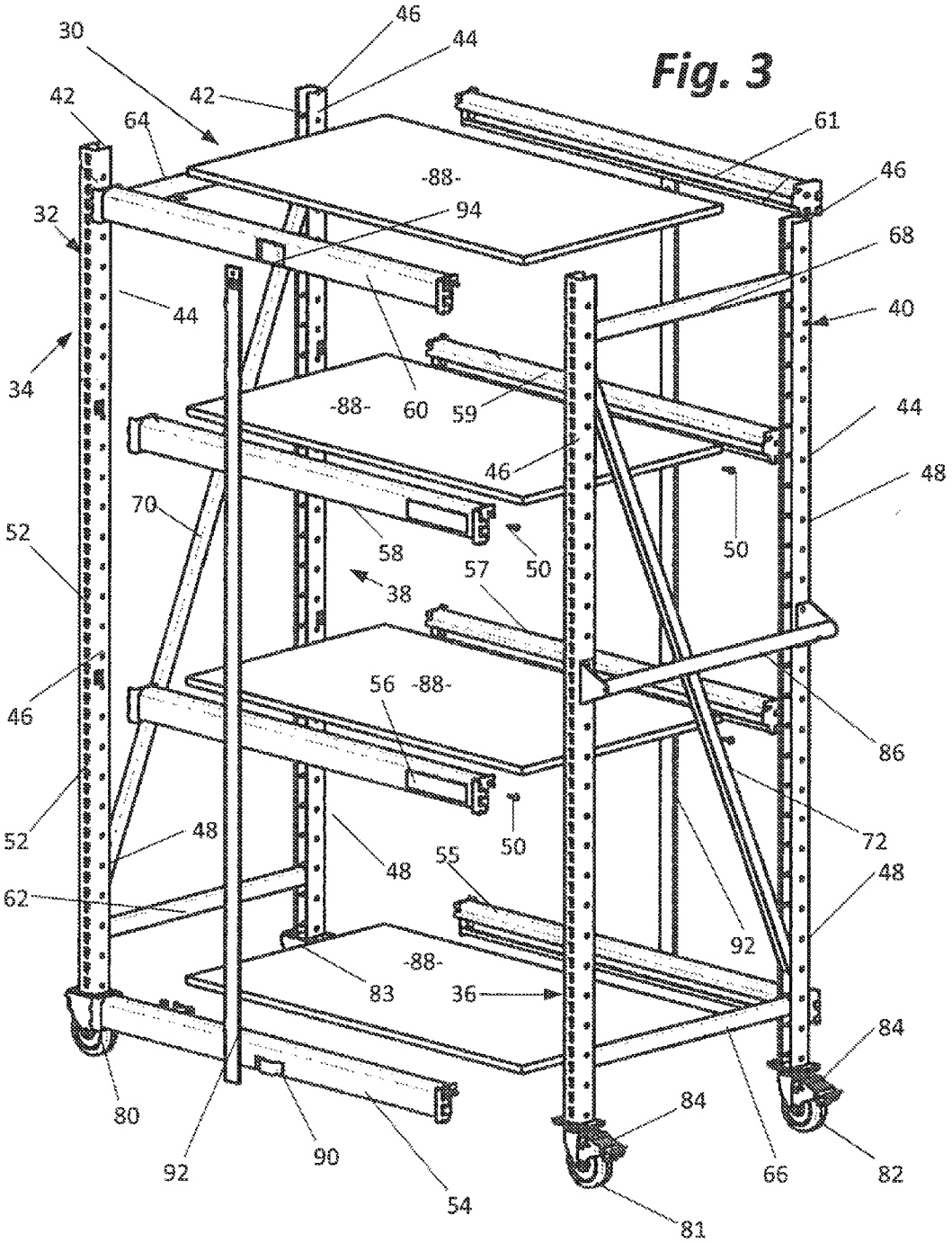
FIG. 3 is an exploded perspective view of a cart for transporting a stack of shelves of the type shown in FIG. 2.
Figure 4:
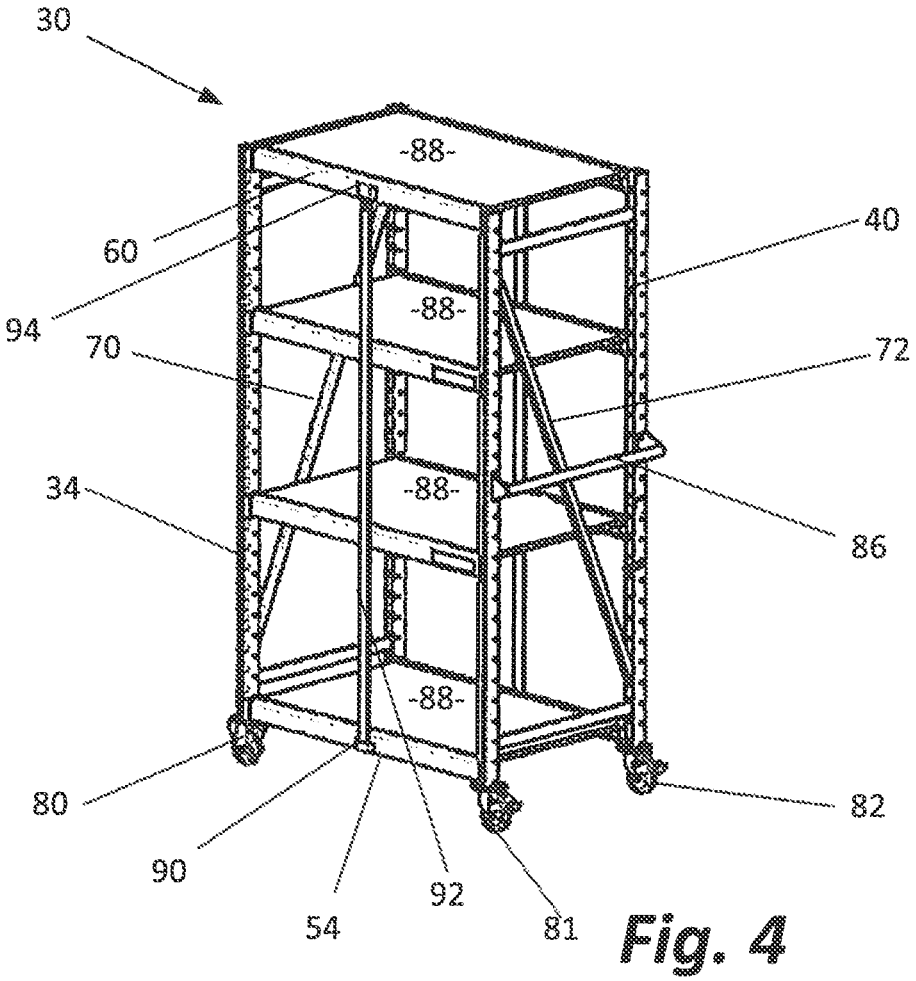
FIG. 4 is an assembled perspective view of the cart shown in FIG. 3.

Lateral support for any stack of shelves 16 placed on the cart 30 may be provided in either or both of two ways. As illustrated in FIGS. 3-7, the bottom horizontal supports 54 and 55 each are provided with a cup 90. As best shown in FIG. 3, cup 90 extends outwardly from the center of the outside surface of the horizontal support 54. The cup has a horizontal bottom wall and an upright sidewall extending up from the bottom wall to define an open top. The cup 90 is sized to receive the bottom end of a removable vertical guard rail 92. The bottom of the cup 90 supports the bottom of the guard rail 92. When the bottom guard rail 92 is in engagement with the bottom of the cup 90, the sidewall of the cup helps retain the guard rail 92 in the cup 90. In addition, top horizontal supports 60 and 61 each have a U-shaped bracket 94. As shown in FIGS. 3-7, the bracket 94 extends out from the center of the outside surface of the horizontal surface of horizontal support 94. The U-shaped bracket 94 is open to the top and bottom. The U-shaped bracket is aligned with the cup 90 and is sized to receive the top end of the vertical guard rail 92. The vertical guard rails 92 are attached to the front and back of the cart 30 by first inserting the top of the vertical guard rail 92 from the bottom through the U-shaped bracket 94. The vertical guard rail 92 is then advanced through bracket 94 until the bottom of the vertical guard rail 92 is above the open top of cup 90. The bottom of the guard rail 92 is then lowered into the cup until contact is made between the bottom of vertical guard rail 92 and the bottom of cup 90. The vertical guard rail 92 is long enough such that its top end is captured and retained by U-shaped bracket 94 and its bottom end is retained by cup 90. To remove the vertical guard rail 92, the bottom is lifted out of the cup 90 and then lowered until the top of the vertical guard rail exits the bottom of the U-shaped bracket 94.

The vertical guard rails 92 provide lateral support to a stack of shelves 16 while the shelves are on the cart 30. However, their design requires they be removed before loading or unloading of the cart 30 may take place. Thus, they provide no safety or security during the loading and unloading process. For this reason, horizontal guard rails 100 are also provided.

Figure 6:
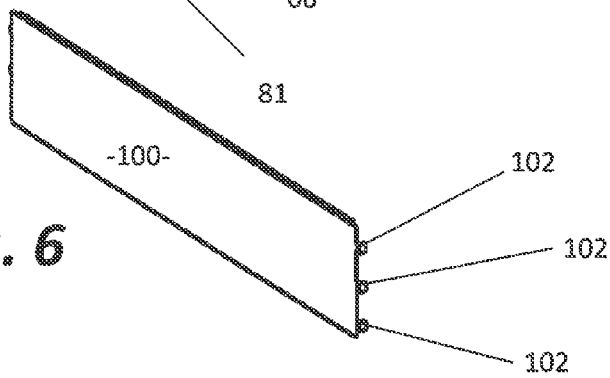
FIG. 6 is a perspective view of a horizontal guard rail of the type shown in FIG. 5.
Figure 7:
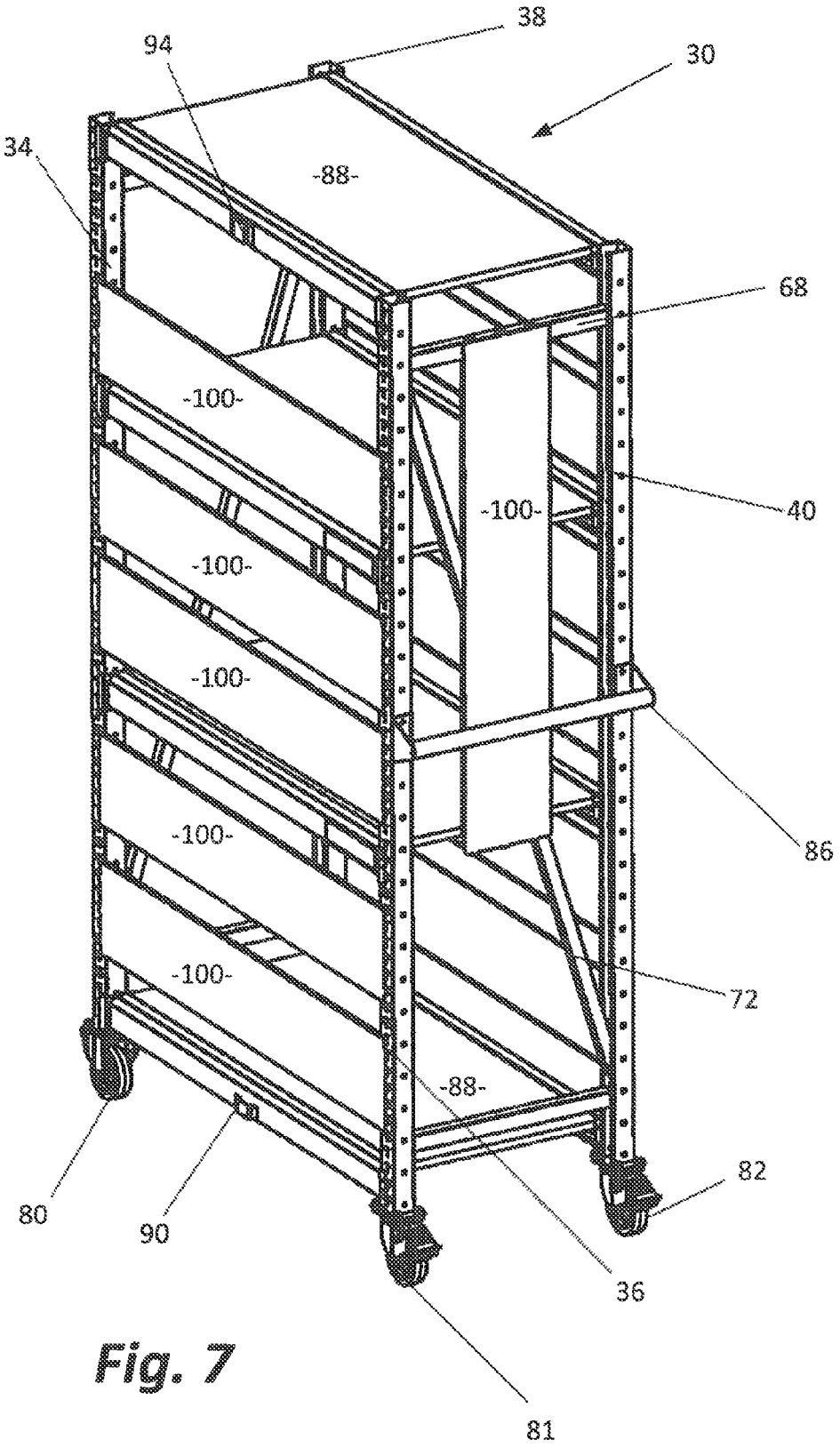
FIG. 7 is a perspective view of the cart shown in FIG. 5 with one of the horizontal guard rails removed and stowed.
Figure 8:
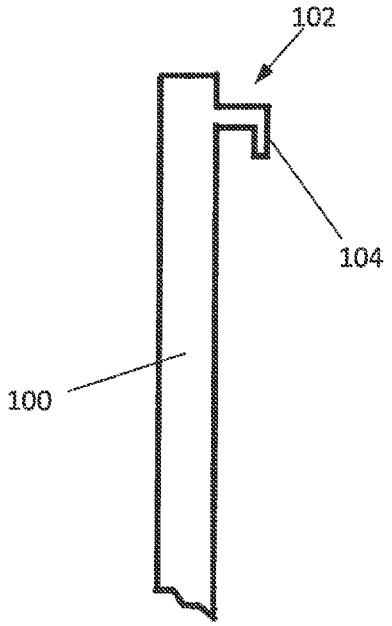
FIG. 8 is a partial side view of a horizontal guard rail including a first knob type.
Figure 10:
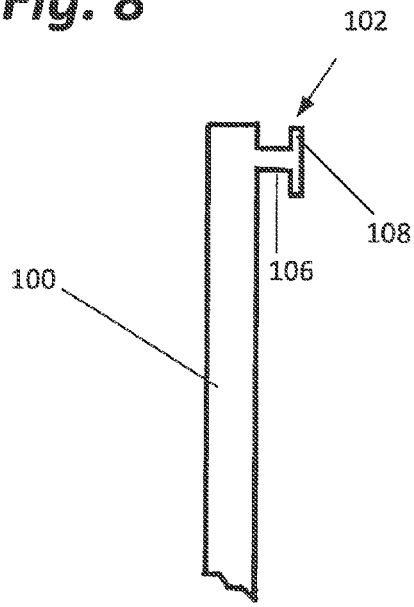
FIG. 10 is a partial side view of a horizontal guard rail including a second knob type.

As shown in FIGS. 5-8 and 10, each horizontal guard rail 100 comprises a substantially flat plate. Extending perpendicularly in a first direction from the inside surface of the plate at opposite ends of the plate are sets of knobs 102. The knobs 102 are sized and shaped to be coupled to the holes 52 in the cross member 46 of the pillars 34 and 36 or the pillars 38 and 40. For example, the horizontal guard rail 100 may be coupled to pillars 34 and 36 of the frame by inserting one set of the knobs 102 into the holes 52 of pillar 34 and the other set of holes in the holes 52 of pillar 36. If the holes 52 are rectangular as shown in FIG. 9, the knobs 102 have a hook-shape 104 as shown in FIG. 8. If the holes 52 have a larger top portion 110 and a smaller bottom portion 112 as illustrated in FIG. 11, the knobs 102 comprise a shaft 106 terminating in an outwardly projecting flange 108 as shown in FIG. 10. The width (diameter) of shaft 106 is smaller than the lower portion 112 of hole 52 shown in FIG. 11 while the flange 108 has a width (diameter) larger than the width (diameter) of the bottom portion 112 of hole 52, but smaller than the width (diameter) of the top portion 110 of hole 52 as shown in FIG. 11. One advantage of the arrangement shown in FIGS. 10 and 11 is that the same horizontal guard rail 100 can be used on the front or the back of the cart and the horizontal guard rail has no fixed top or bottom. This same advantage may be achieved using rectangular holes as shown in FIG. 9, if the knobs 104 have a rectangular flange providing a contour cross-section similar to that shown in FIG. 9.

Figure 5:
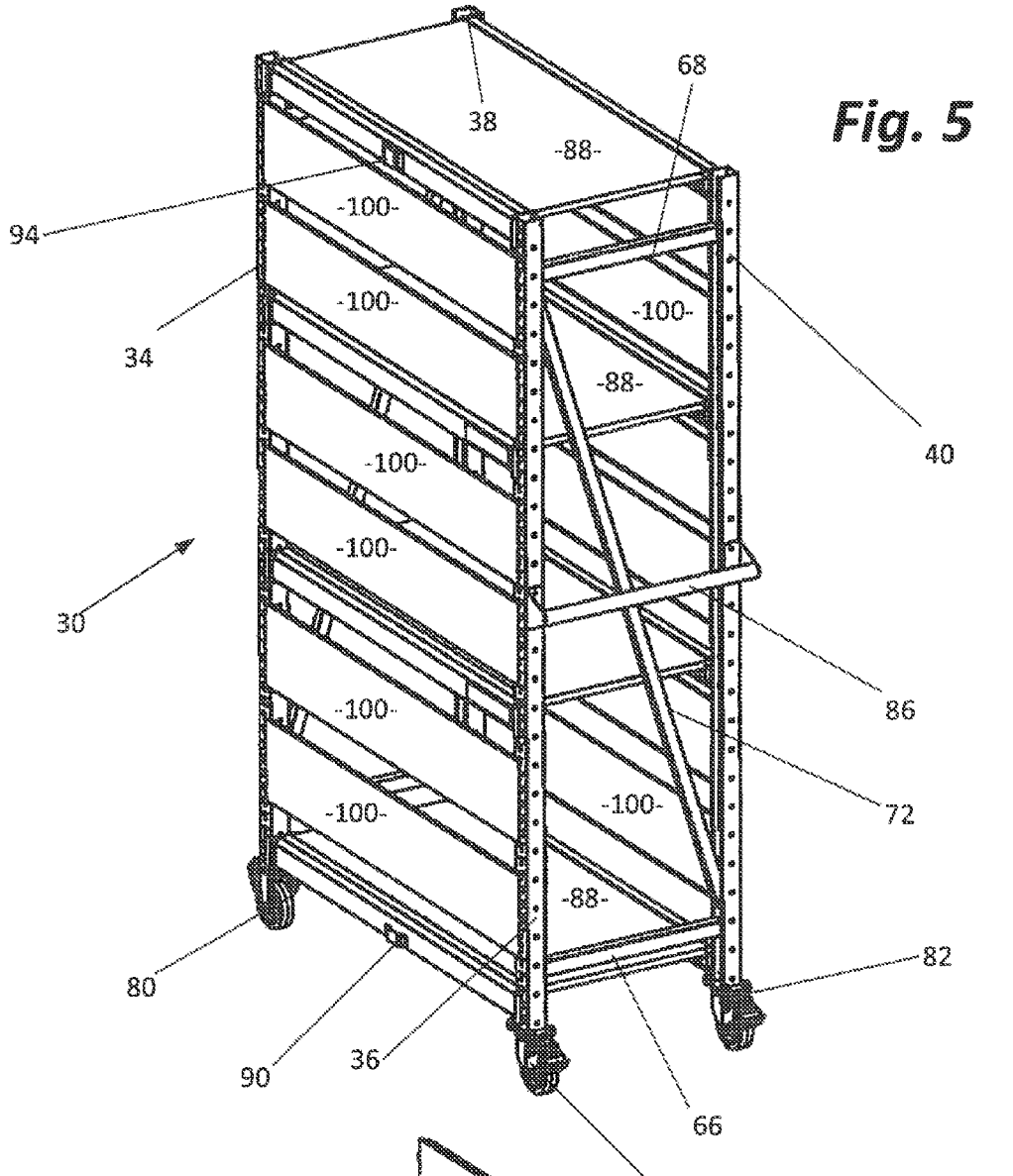
FIG. 5 is an assembled perspective view of the cart shown in FIG. 3 with a plurality of horizontal guard rails in place.

As shown in FIGS. 5 and 7, a series of horizontal guard rails 100 of the type shown in FIG. 6 may be provided. These are added to the cart 30 starting at the bottom as the stack(s) get higher to provide lateral support and are removed from the cart starting at the top as shelves 16 are removed from the stack. As such, the horizontal guard rails prevent tipping of a stack of shelves 16 not only after the stack has been completed, but also while the stack is being formed or is being dismantled. Further, because the horizontal guard rails 100 are added as the stack is being created and removed as the stack is being dismantled, sufficient lateral support is provided without the guard rails 100 unduly interfering with stacking or unstacking of the shelves 16.

Based on the foregoing, it should be apparent that a user can elect not to use either the vertical or the horizontal guide rails, can select between the horizontal and vertical guide rails or can elect to use the vertical and the horizontal guide rails. Maximum security is achieved when the shelves 88, horizontal guard rails 100 and vertical guard rails 92 are all employed. When all these are employed, the vertical guard rails 92 are affixed after the horizontal guard rails 100 have been attached to the cart 30. The cart 30, shelves and the horizontal and vertical guard rails can, of course, be sold as a kit to enable the user to determine which of the safety features to employ.

The invention has been described herein in considerable detail, in order to comply with the patent statutes and provide those skilled in the art with information needed to apply the novel principles and to construct and use embodiments of the example as required. However, it should be understood that the invention can be carried out by specifically different devices and modifications can be accomplished without departing from the scope of the invention itself.

What is claimed is:

1. A cart for storing and transporting shelving comprising:

a. a frame having a front pair of pillars comprising a left front vertical pillar and a right front vertical pillar joined to each other by a plurality of front horizontal supports, a back pair of pillars comprising a left back vertical pillar and a right back vertical pillar joined to each other by a plurality of back horizontal supports, a plurality left horizontal side supports joining the left front vertical pillar and the left back vertical pillar, a plurality of right horizontal side supports joining the right front vertical pillar and the right back vertical pillar, a left oblique support extending between a top section of one of the left front and back vertical pillars and a bottom section of the other of the left front and back vertical pillars, and a right oblique support extending between a top section of one of the right front and back vertical pillars and a bottom section of the other of the right front and back vertical pillars;

b. a set of wheels supporting the frame;

c. at least one shelf supported by the frame;

d. at least one guard rail extending vertically between at least two of the horizontal supports of the frame; and e. means for temporarily securing the guard rail to the frame comprising a cup projecting from one of the at least two horizontal supports for supporting a bottom of a guard rail and a u-shaped bracket projecting from another of the horizontal supports for supporting the guard rail proximate an upper portion thereof.

2. The cart of claim 1 wherein said guard rail extends horizontally between at least one of the front and rear pairs of pillars adjacent the at least one shelf.

3. The cart of claim 2 wherein the means for temporarily securing the guard rail to the frame include knobs extending from a surface of the guard rail which are adapted to be coupled to holes in the pillars.

4. The cart of claim 3 wherein the knobs are hook shaped.

5. The cart of claim 4 wherein the knobs have a shaft of a first width terminating in a flange of a second width larger than the first width.

6. The cart of claim 1 further comprising at least one first guard rail extending horizontally between at least one of the front and rear pairs of pillars and at least one second guard rail extending vertically between at least two of the horizontal supports of the frame.

7. The cart of claim 6 wherein the means for temporarily securing the at least one first guard rail to the frame includes holes in the pillars adapted to receive knobs extending from the at least one first guard rail and a cup and U-shaped bracket coupled to separate horizontal supports of the frame supporting upper and lower end portions of at least one second guard rail.

8. The cart of claim 1 further including plurality of vertically spaced shelves supported by the frame.

9. A kit for storing and transporting shelving comprising:

a. a cart comprising (i) a frame having a front pair of pillars comprising a left front vertical pillar and a right front vertical pillar a first fixed distance from each other and joined together by a at least a lower front horizontal support having a first cup projecting outwardly therefrom and an upper front horizontal support vertically separated from the lower front horizontal support and having a first bracket projecting outwardly therefrom, the first cup and first bracket being in alignment with each other, the left front vertical pillar and the right front vertical pillar each having a plurality of vertically spaced holes therethrough; a back pair of pillars comprising a left back vertical pillar and a right back vertical pillar a first fixed distance from each other and joined together by at least a lower back horizontal support having a second cup projecting outwardly therefrom and an upper back horizontal support vertically separated from the lower back horizontal support and having a second bracket projecting outwardly therefrom, the first cup and first bracket being in alignment with each other, the left back vertical pillar and the right back vertical pillar each having a plurality of vertically spaced holes therethrough; and (ii) a set of wheel assemblies supporting the frame;

b. a plurality of shelf assemblies arranged to be coupled to and supported by the frame, each shelf assembly comprising a shelf and means to couple the shelf to the frame so that the shelf is substantially perpendicular to the vertical pillars of the frame;

c. a plurality of horizontal guard rails each having a length longer than the first fixed distance, each of the horizontal guard rails having a rear surface and a first set of knobs and a second set of knobs extending from the rear surface, wherein the first set of knobs and the second set of knobs are adapted such that the horizontal guard rail may be secured to the frame by inserting the first set of knobs onto holes of one of the pillars and the second set of knobs into holes of the other of the pillars of a pair of pillars; and d. a plurality of vertical guard rails having a first end adapted to be inserted into and supported by a selected one of the first and second cups and a second end adapted to be inserted into and supported by the bracket aligned with the selected one of the first and second cups.

10. The kit of claim 9 wherein at least some of the wheels assemblies of the cart are castered.

11. The kit of claim 9 wherein the cart also includes a handle.

12. The kit of claim 9 wherein the frame also includes at least one oblique support member.

13. The kit of claim 9 wherein the means to couple the self to the frame include grooves in the horizontal supports for receiving a shelf edge therein.

14. The kit of claim 9 wherein the vertically spaced holes are rectangular in shape and the knobs have a hook shape.

15. The kit of claim 14 wherein the vertically spaced holes are constructed to include larger upper section and a smaller lower section and the knobs include a shaft and a flange, the lower section of the hole being wider than the shaft and narrower than the flange and the upper section of the hole being wider than the flange.

* * * * *